United States Patent [19]

Richter

[11] Patent Number: 4,592,219

[45] Date of Patent: Jun. 3, 1986

[54] KEYHOLDER

[75] Inventor: Herbert Richter, Pforzheim-Buechenbronn, Fed. Rep. of Germany

[73] Assignee: Herbert Richter, Metallwaren-Apparatebau GmbH & Co., Pforzheim-Buechenbronn, Fed. Rep. of Germany

[21] Appl. No.: 724,971

[22] Filed: Apr. 19, 1985

[30] Foreign Application Priority Data

Jan. 5, 1985 [DE] Fed. Rep. of Germany ..... 8500204

[51] Int. Cl.[4] ..... A47G 29/10

[52] U.S. Cl. ..... 70/456 R; 70/459

[58] Field of Search ..... 70/456 R, 456 B, 459; 24/3 K; D3/61

[56] References Cited

U.S. PATENT DOCUMENTS 3,257,696 6/1966 Miller ..... 70/456 R
3,608,343 9/1971 Kimel ..... 70/456 B

FOREIGN PATENT DOCUMENTS 720198 10/1965 Canada ..... 70/456 R
1125991 7/1956 France ..... 70/456 R

*Primary Examiner*—Robert L. Wolfe
*Attorney, Agent, or Firm*—Klaus J. Bach

[57] ABSTRACT

A keyholder for retaining keys in a bundle comprises a disc-shaped body consisting of two interconnected body halves with a recessed groove having a narrow slot opening circumferentially formed therein and adapted to receive head portions of key retainers which project through the slot opening. A slide cavity extends centrally through the body so as to intersect the circumferential groove with openings provided at opposite ends of the body to permit insertion of the key retainers into the circumferential groove. A slide of a length to fit the slide cavity length is resiliently centered in the slide cavity so as to block the openings in its center position but has an operating structure accessible through a window in one side of the disc member which permits sliding of the slide out of the center position in either direction so as to permit clearing of either of the openings for insertion or removal of key retainers into or from the circumferential groove.

9 Claims, 4 Drawing Figures

KEYHOLDER

BACKGROUND OF THE INVENTION

The invention relates to a keyholder for removably retaining keys together in a key bundle which consists of a disc-shaped body having a recessed groove formed along its edge with preferably ball-shaped retaining members disposed in the groove and adapted to engage a number of keys. The body has a passage for inserting the retaining members into the recessed groove and a spring-loaded slide is so disposed in the body that in its normal position the slide closes the passage to prevent disengagement of the key retaining members from the disc-shaped body.

Such a keyholder is known, for example, from the German Utility Model No. 1900399 which shows a circular disc having a passage closed by a movable slide.

Experienece shows that, on the average, four keys are used with each keyholder. For the exchange or removal of a key which is not arranged next to the passage, that is, whenever a key is in second or third place in the holder, it is necessary to first remove one or two keys or at least move their retaining members across the passage before such key, that is, its retaining member, can be removed.

It is an object of the present invention to provide a keyholder which is more convenient to use but will retain the key just as safely as the keyholders presently on the market.

SUMMARY OF THE INVENTION

In a keyholder with a disc-shaped body consisting of two interconnected body halves a recessed groove with a narrow slot opening is formed circumferentially between the body halves, the recessed groove being adapted to receive the head portions of key retainers which project through the slot opening for holding keys to the body. A slide cavity extends centrally through the body and intersects the circumferential recessed groove so that openings are provided at the opposite ends of the slide cavity for inserting key retainers into, or removing them from, the circumferential groove. A slide of a length corresponding to the slide cavity length is slidably disposed in the cavity and is retained in its center position by a spring so as to block both openings. The slide is provided with an operating structure and one of the disc halves has a window into which the operating structure extends to permit sliding of the slide out of its center position in either direction to thereby clear either of the openings for the insertion of a key retainer into, or its removal from, the disc-shaped body.

The keyholder according to the invention has not only one passage for the key retaining members but two passages which are arranged opposite one another and which both are closed by a single slide member. As a result, with four keys, each of the keys is adjacent a passage so that any key may be easily removed or replaced.

Besides the keyholder design as given herein is very simple and easy to manufacture. The disc-shaped body is separated in the disc plane, that is, it consists of two halves which can be easily combined. Only one groove extending straight across the body needs to be provided for receiving the slide and providing the two passages normally closed by the slide. Preferably, the slide is trough-shaped and a coil-type compression spring is disposed therein and abuts two pegs formed in the disc halves. Also preferably, the trough cavity walls are stepped such that it has a middle section of increased width corresponding to the diameter of, and receiving, the coil spring and opposite end sections of smaller width into which the pegs of the disc halves extend just adjacent the spring ends. The slide is resiliently centered in a middle position without the need for special stop members.

It has been found to be advantageous if the disc is not circular as is usually the case but of another, preferably squared, shape. This advantage is especially noticeable when the keys need to be grasped in the dark, since then the locations of the, for example, two and two keys (at opposite sides of the disc) can be found more easily.

SHORT DESCRIPTION OF THE DRAWINGS

DESCRIPTION OF THE PREFERRED EMBODIMENT

Figure 1:
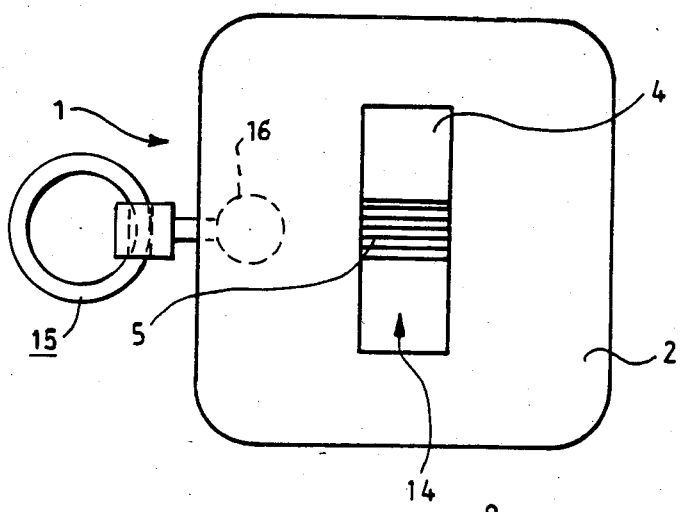
FIG. 1 is a view of one side of the key retainer.
Figure 2:
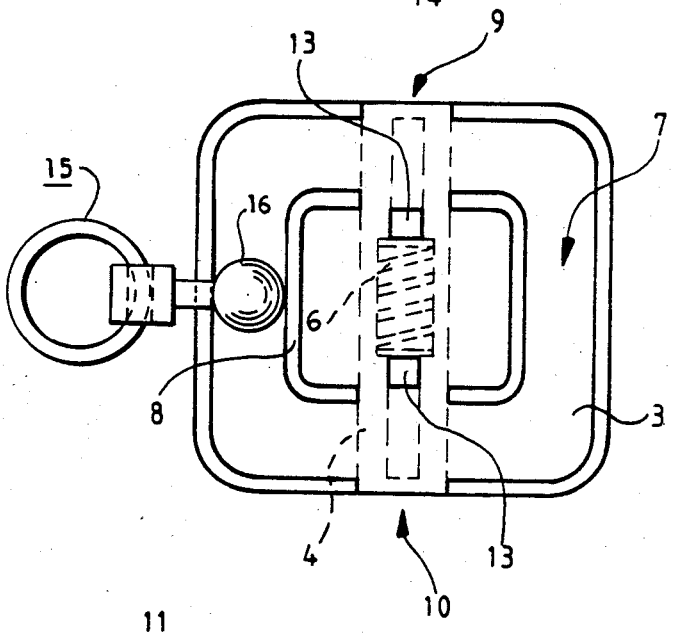
FIG. 2 is a view of a disc half showing in dashed lines the slide and the coil-type compression spring.

As shown in FIGS. 1 and 2 the keyholder 1 consists of two disc halves 2, 3 which are mounted together and receive therebetween a slide 4 provided with an operating structure 5 and containing within a coil-type compression spring 6. At its circumference the keyholder disc has a recessed groove 7 formed therein with a narrow slot opening to the outside. Nesting strips 8 adapted to engage one another during assembly are provided in the opposite disc halves to insure correct positioning of the disc halves 2, 3 upon assembly of the keyholder.

Figure 3:
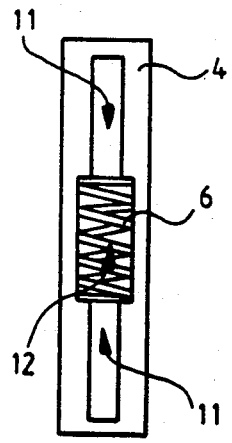
FIG. 3 is a bottom view of the slide with the compression spring inserted.
Figure 4:
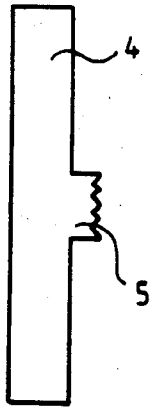
FIG. 4 is a side view of the slide of FIG. 3.

Both disc halves are provided at opposite sides with passages 9, 10 in which the opposite ends of the slide 4 are normally disposed. As shown in FIG. 3, the slide has stepped trough sections 11, 12 formed therein with the center trough section 12 being somewhat wider and receiving the coil spring 6 and the end sections 11 being narrower than the spring diameter so that the spring 6 is engaged axially by the steps of the walls of the trough 11, 12. The disc half 3 has pegs 13 which project therefrom into the narrower trough sections 11 adjacent the ends of the spring 6 and which are slidably received therein. In this manner the slide 4 is resiliently retained in a center position but is slidable out of its normal center position against the force of the spring 6 by applying a sliding force to the operating structure 5 which projects into a window 14 formed in one of the two body disc halves. Key retainers 15 with ball-shaped retaining members 16 are received in the recessed circumferential groove in a known manner. The circumferential groove 7 is divided by the slide into two groove areas each of which may receive, for example, two key retainers so that each key retainer can be easily and directly removed from the groove 7 by appropriate operation of the slide. It is noted, however, that more or less than the exemplary four key retainers can be used in connection with the keyholder according to the invention.

Since the keyholder as shown has an essentially square outside configuration and since the keys are divided into two distinct groups, it is easy to find certain keys even when it is dark. Finally, it is noted that the keyholder according to the invention is very economical to manufacture which is very important for articles which are to be manufactured in large numbers.

I claim:

1. A keyholder for retaining keys in a bundle, said keyholder comprising a disc-shaped body having a circumferential recessed groove formed therein, said groove having a slot-type opening and being adapted to receive head portions of key retainers which project through the slot-type opening, a slide cavity extending centrally through said disc-shaped body and intersecting said circumferential groove with openings provided at opposite ends of said disc-shaped body such that the head portions of said key retainers may be inserted into said circumferential groove through said openings and a slide disposed in said slide cavity, said slide having a length corresponding to the length of said slide cavity extending through said body and being resiliently centered therein so as to block said openings and means for moving said slide out of its center position in said slide cavity in one or the opposite direction thereby clearing either one or the other of said openings for permitting a key retainer's insertion into, or removal from, said groove.

2. A keyholder according to claim 1, wherein said disc-shaped body consists of two disc halves mounted together along a central separation plane.

3. A keyholder according to claim 2, wherein at least one of said disc halves has an elongated window formed therein so as to expose a portion of said slide and said slide has an integral operating structure projecting into said window for moving said slide in said one or opposite direction.

4. A keyholder according to claim 3, wherein the height of said operating structure on said slide corresponds to the thickness of the wall of said disc half.

5. A keyholder according to claim 2, wherein said slide has stepped trough sections formed therein with a center trough section of greater width than the adjacent trough end sections, a coil-type compression spring is disposed in said central trough section and one of said disc halves has pegs projecting therefrom into said trough end sections adjacent opposite ends of said spring so as to resiliently retain said slide in the center position within said body cavity.

6. A keyholder according to claim 5, wherein said pegs are recessed inwardly from the inner wall of said circumferential groove a distance corresponding to the thickness of the end face walls of said slide so as to permit sliding of said slide with either end completely out of said circumferential groove.

7. A keyholder according to claim 1, wherein said disc halves have nesting strips formed at the inner boundary of said recessed grooves, said nesting strips projecting toward, and being shaped so as to engage, one another upon assembly of said disc halves.

8. A keyholder according to claim 1, wherein said disc-shaped body is essentially a square with rounded corners.

9. A keyholder according to claim 1, wherein said key retainers are ball-headed retaining members, the ball heads being received in said recessed groove with said body and a section extending through the circumferential narrow slot and carrying said rings for holding keys.

* * * * *